US005447195A

United States Patent [19]

Luyts

[11] Patent Number: 5,447,195

[45] Date of Patent: Sep. 5, 1995

[54] HEAT EXCHANGER

[75] Inventor: Guido Luyts, Ekeren, Belgium

[73] Assignee: Atlas Copco Airpower, Naamloze vennootschap, Boomsesteenwetg 957, B-2610 Wilrijk, Belgium

[21] Appl. No.: 258,694

[22] Filed: Jun. 13, 1994

[30] Foreign Application Priority Data

Jun. 11, 1993 [BE] Belgium ..... 09300591

[51] Int. Cl.[6] ..... F28F 9/22

[52] U.S. Cl. ..... 165/159; 165/162

[58] Field of Search ..... 165/159–162, 165/145

[56] References Cited

U.S. PATENT DOCUMENTS

| | | | |
|---|---|---|---|
| 1,401,717 | 12/1921 | Halleck | 165/145 |
| 1,410,561 | 3/1922 | Forseille | 165/159 |
| 1,599,370 | 9/1926 | Muhleisen | 165/161 |
| 1,841,528 | 1/1932 | Gebhardt | 165/161 X |
| 1,848,197 | 3/1932 | Ray et al. | 165/162 X |
| 2,595,822 | 5/1952 | Uggerby | 165/159 |
| 3,309,072 | 3/1967 | Cummings | 165/162 X |
| 3,830,289 | 8/1974 | Olson | 165/51 |
| 3,907,030 | 9/1975 | Moss et al. | 165/162 |

FOREIGN PATENT DOCUMENTS

| | | | |
|---|---|---|---|
| 402945 | of 0000 | France . | |
| 1218287 | of 0000 | France . | |
| 1397095 | of 0000 | France . | |
| 2205659 | of 0000 | France . | |
| 297231 | 1/1992 | Germany | 165/159 |
| 185993 | 10/1984 | Japan | 165/159 |
| 816838 | 7/1959 | United Kingdom | 165/162 |
| 230195 | 1/1973 | U.S.S.R. | 165/159 |

*Primary Examiner*—Leonard R. Leo
*Attorney, Agent, or Firm*—Bacon & Thomas

[57] ABSTRACT

Heat exchanger comprising at least one pipe bundle (5, 27, 31) for a first fluid, a jacket (1, 17) surrounding said pipe bundle (5, 27, 31), closed at each end by end pieces (2, 23, 24) through which the pipes (5, 27, 31) extend, and with at least one entrance (3, 29, 33) and one exit (4, 30, 32) for a second fluid, with baffle walls (6, 39) between the entrance and exit, perpendicular to the pipes (5, 27, 31), for reversing the direction of flow of the second fluid, whereby said baffle walls leave a passage (10) for said second fluid alternately on one side and the other of the jacket (1, 17), characterised in that the baffle walls (6, 39) are formed by at least one baffle plate (7, 28, 34) and at least one wall (8, 37, 38) extending over part of the inner circumference of the jacket (1, 17) and pointing inwards, to which is connected the outer edge of the baffle plate (7, 28, 34), so that where there is no wall (8, 37, 38), the passage (10) for the second fluid remains open.

20 Claims, 2 Drawing Sheets

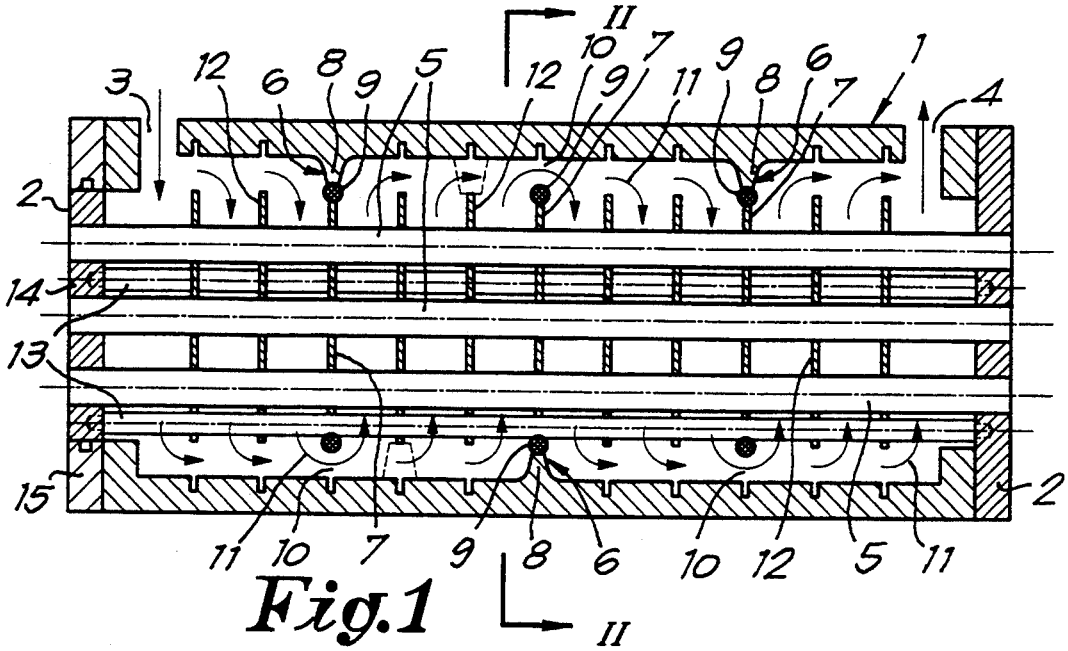
Fig.1
Fig.2
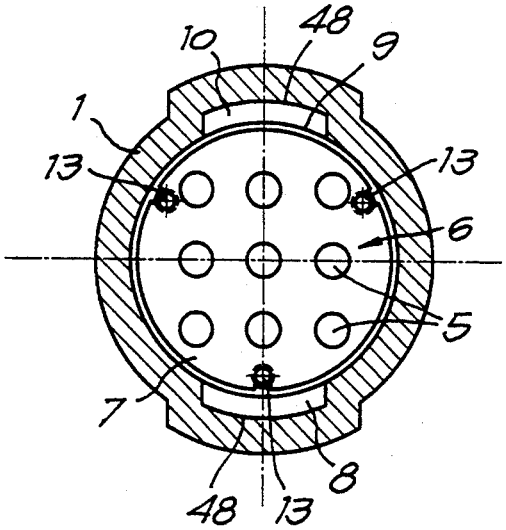
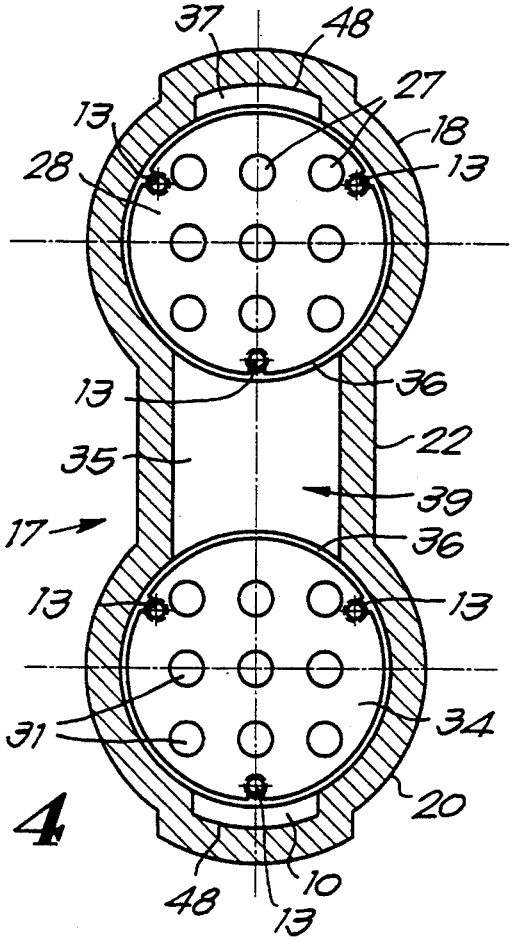
Fig.4

HEAT EXCHANGER

The invention concerns a heat exchanger which comprises at least one bundle of pipes for a first fluid, a jacket surrounding said pipes, closed at either end by end pieces through which the pipes extend and having at least one entrance and exit for a second fluid, and baffle walls between the entrance and exit, perpendicular to the pipes, to reverse the flow of the second fluid, said baffle walls having a free passage for said second fluid alternately at one side and the other of the jacket.

DISCUSSION OF THE PRIOR ART

In known heat exchangers of this type with a cylindrical jacket, the baffles consist of baffle plates in the form of a circle cut off at one side, with a diameter equal to the inside diameter of the jacket. Said baffle plates are mounted in the jacket such that they leave open successive passages for the second fluid perpendicularly opposite each other. In such heat exchangers the flow of the second fluid is partially perpendicular but partially also parallel to the bundle, which limits the heat transfer.

Further, said known heat exchangers contain dead corners, and furthermore dead spaces can form between the final baffles and the end plates if the bundle is incorrectly positioned, in which the second fluid is more or less stationary, leading to accumulation of sediment and locally high temperatures, resulting in lower heat transfer as well as corrosion. Also in the case of said known heat exchangers, it is difficult for the baffles next to the passage to be connected in a leakproof manner to the jacket. Leaks between the jacket and the edge of the baffle also reduce the cooling power.

Said known heat exchangers are also difficult to adjust, for example to obtain a higher speed of the second fluid. They are calculated to work in an optimum manner at a certain temperature and flow rate of the fluid. A large reduction in the flow rate of the second fluid reduces the heat exchanging capacity, due to the lower speed of said second fluid, and due to a lower temperature difference between the fluids.

SUMMARY OF THE INVENTION

The present invention has as its aim to avoid these disadvantages and to provide a heat exchanger which is relatively cheap but which nevertheless offers excellent heat transfer, without dead corners, and which in one embodiment can also be adjusted in an economical manner as regards the flow of the second fluid and so as to offer the possibility of mounting several pipe bundles for the first fluid in the same jacket.

This aim is achieved according to the invention in that the baffles are formed by at least one baffle plate and at least one wall stretching over part of the inside circumference of the jacket and facing towards the inside, to which the outside edge of the baffle plate is connected, so that the passage for the second fluid remains where there is no wall.

The walls standing on the jacket can form a single piece with the jacket or can be loose walls, or a number of the walls can be fixed and a number loose.

By using loose walls it is easy to adjust the flow of the second fluid by removing or adding walls.

In a preferred embodiment of the invention, the heat exchanger has at least one transverse partition between successive baffle walls and/or an outer baffle wall and an end piece, perpendicular to the pipes, where said partition lies at a distance from the inside of the jacket over part of its outer edge.

As a result of this transverse partition, the flow of the second fluid is not reversed but is divided into parallel, smaller flows, so that a more transverse flow of said fluid over the pipes is obtained, and thus even better heat transfer. By placing loose walls on the jacket around the transverse partitions, extra baffle walls can easily be formed, with the transverse partitions becoming baffle walls. Conversely, by removing a loose wall around a baffle plate, the baffle wall can be made to disappear, with the baffle plate still functioning as transverse partition.

Said transverse partition can have the same size and shape as the baffle plates, only it is not connected to a wall on the inside of the jacket.

In an advantageous embodiment of the invention, there is a seal between a wall on the inside of the jacket and the outside of a baffle plate.

In this embodiment in particular, leak flows between the baffle plate and the wall are avoided, and the full flow of the second fluid has to flow through the passage formed by the interruption in the wall.

In the normal embodiment of the invention, the jacket is partly cylindrical and the baffle plates are round, with a diameter that fits in the inner diameter of the jacket. The jacket widens at opposite sides to form channels in which the flow of the second fluid is redirected.

In this case the heat exchanger normally comprises only one pipe bundle for the first fluid.

The heat exchanger can also comprise more than one pipe bundle, with the bundles parallel to each other and surrounded by one jacket, whereby one of the pipe bundles is longer than the other, and the baffle walls extend over the various bundles where they lie next to each other.

In this embodiment, the baffle walls which extend over several pipe bundles are advantageously formed by a baffle plate on each of the bundles and at least a wall on the inside of the jacket which shuts off the opening between the two baffle plates and which shuts off the opening between each of the baffle plates and the inside of the jacket, with the exception of the passage.

In this case the heat exchanger can have a cylindrical section of jacket for each pipe bundle, so that the inside spaces of adjacent jacket sections communicate with each other via a passage, and each baffle wall which extends over neighbouring bundles comprises a round baffle plate on each bundle, a wall on each of the wall sections which connects to the corresponding baffle plate and a wall situated in the passage and connecting to the neighbouring baffle plates.

In a particular embodiment of the invention, at least one of the passages between the baffle walls and the jacket, where said passages are formed by the interruptions in the walls on the inside of the jacket, is closed off by a wall standing on said inside with a calibrated passage.

In addition to the entrance and exit near its ends, the jacket can also have a second entrance and exit, in which case there is a baffle wall between said second entrance and exit, with a wall with a calibrated passage mounted in the passage of said baffle wall.

BRIEF DESCRIPTION OF THE DRAWINGS

In order to better explain the characteristics of the invention, some preferred embodiments of a heat exchanger according to the invention are described below, as examples and without being limitative in any way, with reference to the accompanying drawings, where:

FIG. 1 is a longitudinal section of a heat exchanger according to the invention;

FIG. 2 is a cross-section along line II—II in FIG. 1;

FIG. 4 is a cross-section along line IV—IV in FIG. 3.

DETAILED DESCRIPTION OF THE PREFERRED EMBODIMENT

Figure 3:
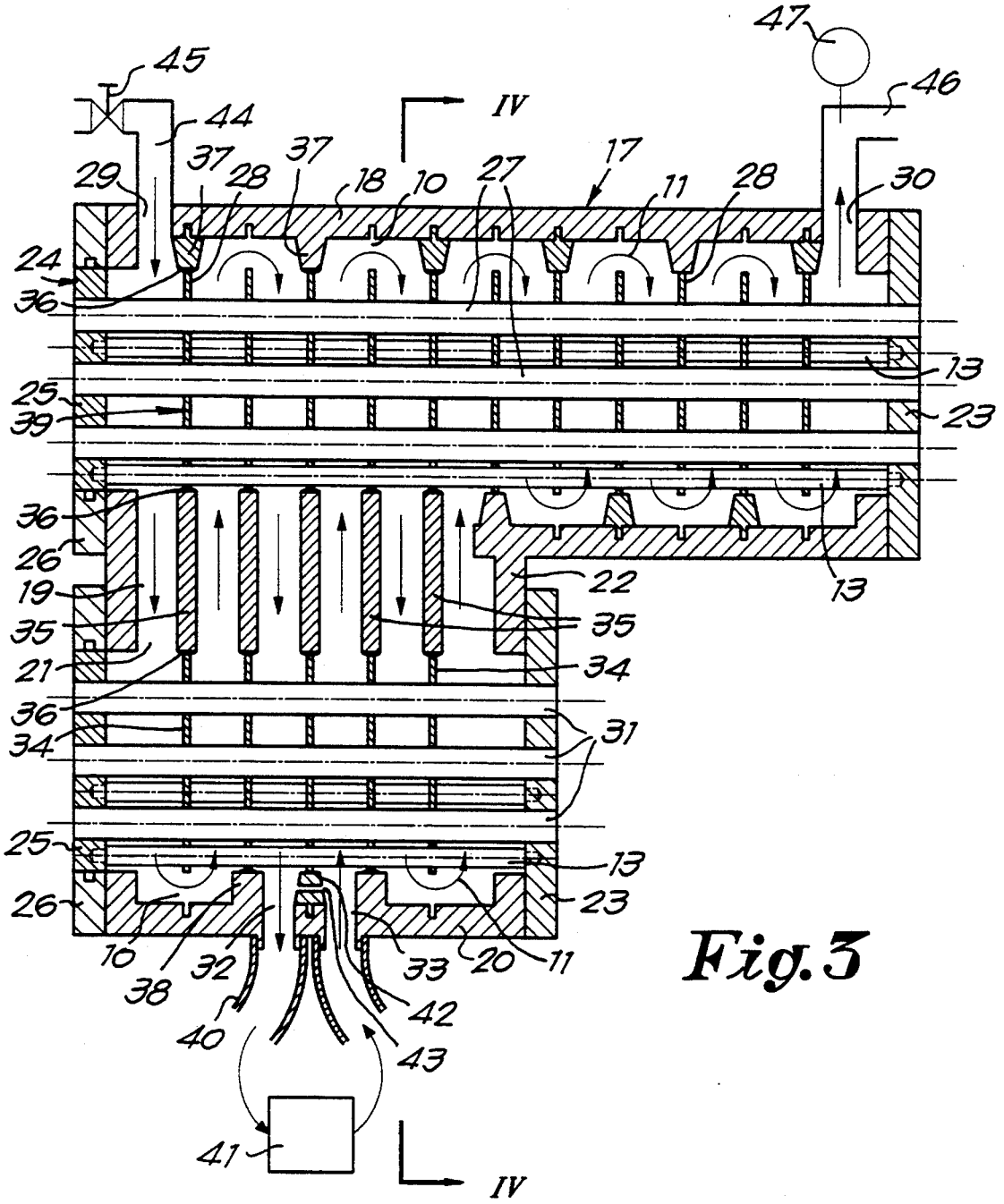
FIG. 3 is a longitudinal section analogous to that in FIG. 1, but for another embodiment of the heat exchanger.

The heat exchanger shown in FIGS. 1 and 2 essentially comprises a jacket 1 both of whose ends are closed by an end piece 2 and which near one end has an entrance 3 and near the other end an exit 4, together with a pipe bundle 5 for a first or primary fluid, extending parallel to the longitudinal direction of the jacket 1 and whose ends extend through the end pieces 2, and a number of baffle walls 6 mounted perpendicular to the pipes 5 inside the jacket 1.

This jacket 1 is mostly cylindrical, but widens at two points diametrically opposite each other so as to form channels 48 through which the fluid can flow.

Characteristic of the invention is the fact that said baffle walls 6 are formed by a round baffle plate 7 through which the pipes 5 extend and whose diameter is slightly smaller than the inside diameter of the jacket 1, and by a wall 8 projecting inwards, standing on the inside wall of the jacket 1, in one of the channels 48, where said wall 8 fits against the outside edge of the baffle plate 7 through the intermediary of a seal 9, thus closing off channel 48. The seal 9 surrounds the baffle plate 7 and also forms a seal between the baffle plate 7 and the inside of the cylindrical part of the jacket 1.

The wall 8 extends over only part of an inside circumference of the jacket 1, so as to close off one single channel 48, so that on one side of the jacket 1, namely at the other channel 48, a passage 10 remains open.

The successive walls 8 are placed so that said passages 10 stand at the location of the baffle walls 6 alternately at one side of the jacket 1 in one channel 48 and at the opposite side in the other channel 48, so that the second fluid, which enters the space between the pipes 5 and the jacket 1 via the entrance 3, is forced to flow in a zig-zag towards the exit 4. The direction of flow of the second fluid is indicated in FIG. 1 by the arrows 11.

Between successive baffle walls 6 and between the outer baffle walls 6 and the end pieces 2 are mounted each time two round, transverse partitions 12 with the same diameter as the baffle plates 7. There is an open space around the whole circumference of these transverse partitions 12. In contrast to the baffle walls 6 the transverse partitions 12 do not change the direction of flow of said fluid, but divide it into three parallel, smaller flows.

The exact positioning of the pipe bundle 5 with respect to the baffle plates 7 and the transverse partitions 12, so that the baffle plates 7 fit against the walls 8, is ensured not only by the end pieces 2 but also by a number of bars 13 parallel to the pipes 5, said bars 13 running through recesses in the baffle plates 7 and in the transverse partitions 12 and being attached at their ends in the end pieces 2.

In order to assemble the pipe bundle 5 in the jacket 1, with the baffle plates 7 and transverse partitions 12 attached, one of the end pieces 2 is formed by an inner, round part 14 with the same diameter as the baffle plates 7 and an annular outer part 15 which can be fitted round the part 14. The one-piece end piece 2 and the part 14 of the two-piece end piece 2 are attached to the pipe bundle 5. The pipe bundle 5 is slid forward through the jacket 1 together with the part 14 until the one-part end piece 2 fits against the jacket 1, whereupon the annular part 15 is attached round the part 14 and fitted against the other end of the jacket 1.

The heat exchanger can be used as a cooler, whereby the first or primary fluid, usually a gas, flows through the pipes 5. The second fluid is then a coolant, usually water, which flows from the entrance 3 to the exit according to the arrows 11. Due to the presence of the baffle plates 7 and additionally the transverse partitions 12, the direction of flow of the cooling fluid is practically perpendicular to the pipes 5 at every point, thus obtaining excellent heat transfer. The cooling fluid does not stand stationary at any point, and dead corners are avoided. An even flow of cooling fluid is obtained. The sealing between the baffle plates 7 and the walls 8 or the cylindrical part of the jacket 1 is ensured, so that the cooling fluid can only flow through the passages 10.

The number of walls 8 and thus the number of baffle walls 6 can be adjusted according to the flow rates of the fluids and the required heat transfer. Thus a wall 8 can be placed at the point of two transverse partitions 12 between two neighbouring baffle walls 6 as shown by the dotted line in FIG. 1. In this way, these transverse partitions 12 form baffle plates 7 which together with the walls 8 form baffle walls 6. Adding or even possibly removing walls 8 in this way can be done when manufacturing the jacket 1, in which case said walls 8 can be fixed and thus form a single part with the jacket 1. However, it is easier if all or at least a number of said walls 8 are loose walls which can be fitted on the inside of the jacket 1 before the pipe bundle 7 is inserted. For this purpose, said jacket 1 is provided on the inside with grooves 16 in the channels 48, for positioning said loose walls 8.

In this way, it is possible to ensure that there are sufficient baffle walls 6 in the jacket 1 to give sufficient speed to the cooling fluid even at minimum flow rate of said cooling fluid. The path of the cooling fluid over the pipe bundles 7 can be controlled and thus the heat transfer adjusted by means of standardised elements, namely walls 8 in combination with round plates which are attached to the pipe bundle 5 and form baffle plates 7 or transverse partitions 12 as required.

Not only can the flow of the secondary or second fluid within the jacket 1 be adjusted, but also two heat exchangers, each with their own pipe bundle 5 can easily be combined to form a single heat exchanger as shown in FIGS. 3 and 4.

In this embodiment, the heat exchanger comprises a jacket 17 consisting of a top, partly cylindrical jacket part 18 with a longitudinal opening 19 underneath extending over part of its length, a bottom, partly cylindrical jacket part 20 located below said opening 19, with its longitudinal axis parallel to the longitudinal axis of the jacket part 18, and with a longitudinal opening 21 above, the same size as the opening 19 and exactly opposite to it, and a connecting part 22 fitted to the jacket parts 18 and 20 and forming a passage between the inside spaces of the jacket parts 18 and 20. The jacket part 18 widens above so as to form a channel 48, while the jacket part 18 similarly widens below so as to form a channel 48.

At one end, the jacket parts 18 and 20 are closed off by their end piece 23, while the other end of the jacket parts 18 and 20 are closed off by a two-part end piece 24 consisting of a round inner part 25 and an annular part 26 fitted round the part 25.

The bottom jacket part 20 and the connection 22 have the same length, which as shown—but not necessarily—is smaller than the length of the jacket part 18.

In the jacket part 18 there is a pipe bundle 27. The pipes 27 are held by their ends in the end piece 23 and the part 25 of the end piece 24. Mounted perpendicularly on the pipes 27 are baffle plates 28 whose diameter fits in the diameter of the wall part 18.

Near each of the ends, the jacket part 18 has an entrance 29 and exit 30 respectively, for the second fluid, for example a coolant.

In the bottom jacket part 20 there is a pipe bundle 31 arranged in a similar manner, with the ends of the pipes held in the corresponding end piece 23 and the part 25 of the corresponding end piece 24.

Approximately in the middle between its ends, the jacket part 20 has an extra exit 32 and next to it an extra entrance 33.

Round baffle plates 34 are also fitted on the pipes 31 in the jacket part 20, whereby the diameter of said baffle plates 34 fits in the inside diameter of said jacket part 20.

In the connection 22 are a number of walls 35 perpendicular to the longitudinal axes of the jacket parts 18 and 20, connecting through the intermediary of a seal 36 to a baffle plate 28 in the top jacket part and a baffle plate 34 in the bottom jacket part 20.

Each of the walls 35, together with the baffle plates 28 and 34 connecting to it, or with a wall 37 standing in the channel 48 of the top jacket part 18, or a wall 38 standing in the channel 48 of the bottom jacket part 20, forms a complete baffle wall 39. The walls 37 and 38 which fit on the baffle plate 28 and the baffle plate 34 respectively through the intermediary of the seal 36, are located so that neighbouring baffle walls 39 form a passage 10 for the second fluid or coolant alternately on one side and the opposite side of the jacket 17.

Also in this embodiment, the walls 37 and 38 can either be fixed or loose. The path covered by the second fluid can therefore be adjusted by adding or removing loose walls. This path is shown in FIG. 3 by arrows 11.

One of the baffle walls 39 is located between the exit 32 and the entrance 33 with its passage 10 at the side of said entrance and exit. A pipe 40 connects to the exit 32, connecting via a circuit 41 back to the entrance 33. In the passage 10 between said baffle wall 39 and the inner wall of the jacket part 20 is a wall 42 with a calibrated passage 43 in a similar manner to a wall 37 or 38 loose-mounted on the inside of the jacket part 20. As a result, part of the second fluid flows not through the pipe 40 but via the passage 43, thus enabling the pressure drop in the circuit 41 to be reduced.

A supply pipe 44 with a valve 45 connects to the entrance 29, while a discharge pipe 46 with a temperature gauge 47 connects to the exit 30. The flow rate of the second fluid can be adjusted by means of the valve 45 according to the temperature measured by the gauge 47. Where the pipe bundle 31 is situated next to the pipe bundle 27, the second fluid is forced by the baffle walls 29 to flow perpendicularly over the two pipe bundles. Where there are no pipes 31 next to the pipes 27, said fluid flows in a zig-zag inside the jacket part 18 between baffle walls 39 formed by a baffle plate 28 and a wall 37 mounted on the inside of the jacket part 18 and connected to the baffle plate 28 by means of a seal 36.

The walls 37 and 38 can either be fixed or loose. The same applies to the walls 35. In this embodiment, transverse partitions can also be mounted between neighbouring baffle walls 39. In the case where two pipe bundles are situated next to each other, a transverse partition can be mounted on each of the bundles, and these transverse partitions can be connected to each other by means of a wall.

The heat exchangers described above offer very good heat transfer in an economical manner, while offering extensive possibilities for modifications using standard components, for example to have several pipe bundles.

The present invention is in no way limited to the embodiments described above and shown in the drawings; on the contrary, such a heat exchanger can be made in different variants while still remaining within the scope of the invention.

I claim:

1. A heat exchanger comprising:

at least one bundle of pipes through which a first fluid is adapted to flow, each of said pipes defining a longitudinal axis;

a jacket having first and second longitudinally spaced end portions, said jacket including an entrance at the first end portion thereof and an exit at the second end portion thereof for a second fluid, said pipes extending longitudinally within said jacket such that said jacket surrounds said pipes, said jacket being substantially cylindrical but widens at opposite sides to form channels;

first and second end pieces positioned at the first and second end portions of said jacket respectively for closing the end portions of said jacket; and baffle means located within said jacket for guiding the second fluid to flow along longitudinally spaced paths substantially perpendicular to said pipes, said baffle means including a plurality of baffle walls and a plurality of baffle plates, said baffle walls being located on the inside of said jacket between said entrance and said exit, said baffle walls projecting inwardly, at spaced, alternating locations in said channels, along portions of an inner circumferential surface of said jacket, said baffle plates being circular in cross-section with corresponding diameters that fit within said jacket, said baffle plates extending substantially perpendicular to said pipes and having first sections connected with a respective one of said baffle walls and second sections which are spaced from the inner surface of the jacket so as to define passages in said channels; each of said passages being located between successive said baffle walls which close off a respective one of said passages, through which the second fluid is guided whereby the second fluid flows substantially perpendicular to said pipes along successive said paths with the direction of flow being reversed as the second fluid flows through said passages.

2. A heat exchanger according to claim 1, wherein at least one of the baffle walls is mounted within a groove formed in the inner surface of said jacket.

3. A heat exchanger according to claim 1, wherein said baffle means further includes at least one partition extending perpendicular to the longitudinal axes of said pipes within said jacket, said at least one partition being spaced from the inner circumferential surface of said jacket.

4. A heat exchanger according to claim 3, wherein said at least one partition has an associated size and shape that is equal to said baffle plates.

5. A heat exchanger according to claim 1, further including a seal between the first section of each of said baffle plates and a respective one of said baffle walls.

6. A heat exchanger according to claim 1, wherein a single bundle of pipes is provided for the first fluid.

7. A heat exchanger according to claim 1, further including a plurality of bars interconnecting said first and second end pieces.

8. A heat exchanger according to claim 1, wherein said pipes extend through said first and second end pieces.

9. A heat exchanger according to claim 8, wherein said first end piece is formed from an inner part which receives said pipes and an outer part that extends about said inner part.

10. A heat exchanger comprising:

at least one bundle of pipes through which a first fluid is adapted to flow, each of said pipes defining a longitudinal axis;

a jacket having first and second longitudinally spaced end portions, said jacket including an entrance at the first end portion thereof and an exit at the second end portion thereof for a second fluid, said pipes extending longitudinally within said jacket such that said jacket surrounds said pipes;

first and second end pieces positioned at the first and second end portions of said jacket respectively for closing the end portions of said jacket:

baffle means located within said jacket for guiding the second fluid to flow along longitudinally spaced paths substantially perpendicular to said pipes, said baffle means including a plurality of baffle walls and a plurality of baffle plates, said baffle walls being located within said jacket between said entrance and said exit, said baffle walls projecting inwardly at spaced locations, along portions of an inner circumferential surface of said jacket, said baffle plates extending substantially perpendicular to said pipes and having first sections each connected with a respective one of said baffle walls and second sections which are spaced from the inner surface of the jacket so as to define passages through which the second fluid is guide whereby the second fluid flows substantially perpendicular to said pipes along successive said paths with the direction of flow being reversed as the second fluid flows through said passages; and a plurality of pipe bundles arranged parallel to each other and surrounded by said jacket with a first one of the pipe bundles being longer than a second one of said pipe bundles, said baffle means including a portion extending about both said first and second pipe bundles.

11. A heat exchanger according to claim 10, wherein the portion of said baffle means that extends about said first and second pipe bundles includes first and second baffle plates through which said first and second pipe bundles extend respectively and first and second baffle walls, said first baffle wall extending between the first and second baffle plates and said second baffle wall extending between one of said first and second baffle plates and said jacket.

12. A heat exchanger according to claim 11, wherein said jacket includes first and second substantially cylindrical parts within which said first and second pipe bundles are located respectively and a widened portion for each of said first and second pipe bundles, said first and second parts of said jacket being spaced by an opening which is closed by said first baffle wall.

13. A heat exchanger according to claim 10, further including a seal between the first section of each of said baffle plates and a respective one of said baffle walls.

14. A heat exchanger according to claim 10, further including a plurality of bars interconnecting said first and second end pieces.

15. A heat exchanger according to claim 10, wherein said pipes extend through said first and second end pieces.

16. A heat exchanger comprising:

at least one bundle of pipes through which a first fluid is adapted to flow, each of said pipes defining a longitudinal axis:

a jacket having first and second longitudinally spaced end portions, said jacket including an entrance at the first end portion thereof and an exit at the second end portion thereof for a second fluid, said pipes extending longitudinally within said jacket such that said jacket surrounds said pipes;

first and second end pieces positioned at the first and second end portions of said jacket surrounds said pipes;

baffle means located within said jacket for guiding the second fluid to flow along longitudinally spaced paths substantially perpendicular to said pipes, said baffle means including a plurality of baffle walls and a plurality of baffle plates, said baffle walls being located within said jacket between said entrance and said exit, said baffle walls projecting inwardly, at spaced locations, along portions of an inner circumferential surface of said jacket, said baffle plates extending substantially perpendicular to said pipes and having first sections each connected with a respective one of said baffle walls and second sections which are spaced from the inner surface of the jacket so as to define passages through which the second fluid is guided whereby the second fluid flows substantially perpendicular to said pipes along successive said paths with the direction of flow being reversed as the second fluid flows through said passages; and wherein at least one of the said passages is formed by interruptions in the baffle walls on the inner circumferential surface of the jacket and is closed off by an additional baffle wall having a calibrated passage formed therein.

17. A heat exchanger according to claim 16, wherein said jacket is provided with a second entrance and a second exit, said additional baffle wall being located between said second entrance and said second exit, said calibrated passage being defined by said additional baffle wall.

18. A heat exchanger according to claim 16, further including a seal between the first section of each of said baffle plates and a respective one of said baffle walls.

19. A heat exchanger according to claim 16, further including a plurality of bars interconnecting said first and second end pieces.

20. A heat exchanger according to claim 16, wherein said pipes extend through said first and second end pieces.

* * * * *

UNITED STATES PATENT AND TRADEMARK OFFICE

CERTIFICATE OF CORRECTION

PATENT NO. : 5,447,195

DATED : September 5, 1995

INVENTOR(S) : LUYTS

It is certified that error appears in the above-indentified patent and that said Letters Patent is hereby corrected as shown below:

COLUMN 8:

Line 28, delete "surrounds said".

Line 29, "pipes" should read --respectively for closing the end portions of said jacket--.

Signed and Sealed this

Nineteenth Day of March, 1996

*Attest:*

Bruce Lehman

BRUCE LEHMAN

*Attesting Officer*

*Commissioner of Patents and Trademarks*